US005419143A

United States Patent [19]

Leonard et al.

[11] Patent Number: 5,419,143

[45] Date of Patent: May 30, 1995

[54] CRYOGENIC APPARATUS FOR SAMPLE PROTECTION IN A DEWAR

[75] Inventors: Rex D. Leonard, Indianapolis; Thomas J. Kroh, Lafayette; Arthur E. Winings, Cloverdale, all of Ind.

[73] Assignee: International Cryogenics, Inc., Indianapolis, Ind.

[21] Appl. No.: 251,387

[22] Filed: May 31, 1994

Related U.S. Application Data

[63] Continuation-in-part of Ser. No. 995,124, Dec. 22, 1992, Pat. No. 5,321,955.

[51] Int. Cl.[6] ..... F17C 11/00; F17C 3/08; F25D 3/10

[52] U.S. Cl. ..... 62/51.1; 62/46.3; 62/78

[58] Field of Search ..... 62/78, 51.1, 46.3, 51.1 R, 62/51.1 I

[56] References Cited

U.S. PATENT DOCUMENTS

| | | | |
|---|---|---|---|
| 3,187,937 | 4/1962 | Berta | 220/94 |
| 3,238,002 | 3/1966 | O'Connell et al. | 62/46.3 |
| 3,303,667 | 2/1967 | Perkins | 62/457.9 |
| 3,707,079 | 12/1972 | Hawker | 62/373 X |
| 3,875,754 | 4/1975 | Faust et al. | 62/60 |
| 4,314,450 | 2/1982 | Pelloux-Gervais | 62/51.1 |
| 4,455,842 | 6/1984 | Granlund | 62/78 X |
| 4,481,779 | 11/1984 | Barthel | 62/46.3 |
| 4,495,775 | 1/1985 | Young et al. | 62/46.3 |
| 4,838,034 | 6/1989 | Leonard et al. | 62/50.2 |

OTHER PUBLICATIONS

International Cryogenics, Inc. product brochure of Liquid Nitrogen Storage Vessel IC 20R.

International Cryogenics, Inc. product brochure of Liquid Nitrogen Storage Vessel IC 20VS.

*Primary Examiner*—Christopher Kilner

*Attorney, Agent, or Firm*—Willian Brinks Hofer Gilson & Lione

[57] ABSTRACT

An element comprised of a cryoretentive material is adapted for insertion into and support within the inner vessel of a cryogenic dewar adjacent one or more sample holders. Such a cryoretentive element may be adapted for disposition within the canister of existing sample holders and for acceptance of one or more samples, thus permitting the convenient conversion of unprotected dewars for protection against upsets and for improved sample holding times. Such elements provide a convenient and inexpensive conversion of cryogenic dewars for shipping, an improved ability to maintain samples in a cold state for longer periods of time and an improved sample holder with protection against a loss of liquid cryogen.

22 Claims, 9 Drawing Sheets

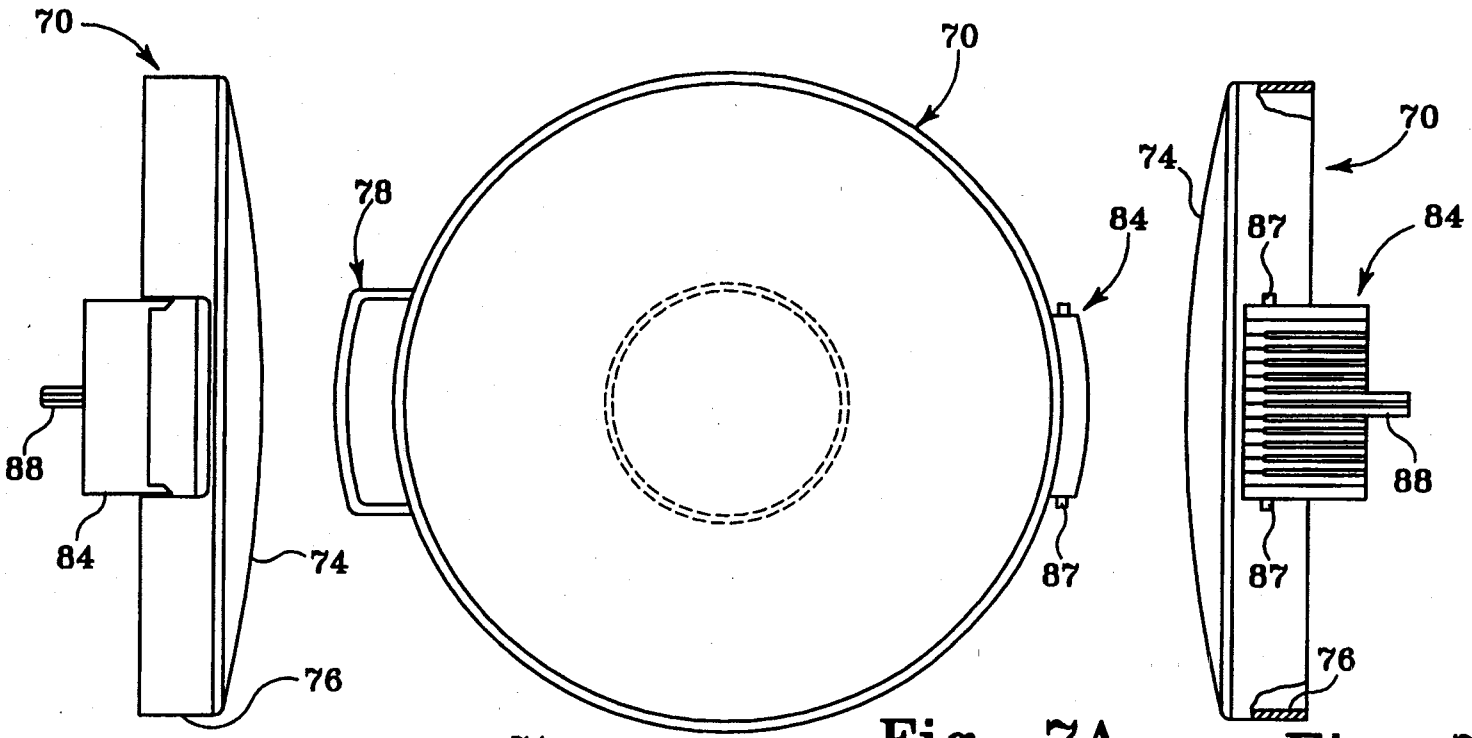
Fig. 7C
Fig. 7A
Fig. 7B
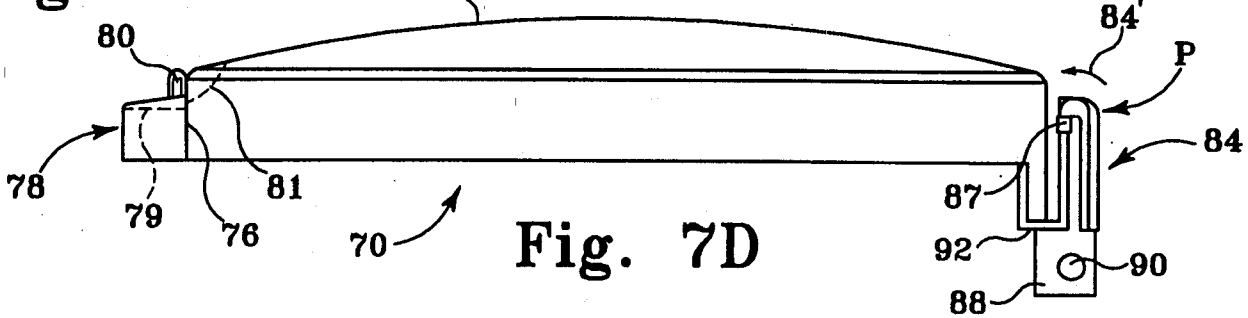
Fig. 7D

CRYOGENIC APPARATUS FOR SAMPLE PROTECTION IN A DEWAR

Related Applications

This application is a continuation-in-part of U.S. application Ser. No. 07/995,124, filed Dec. 22, 1992.

FIELD OF THE INVENTION

This invention relates to cryogenic shipping vessels and, more particularly, to a cryoretentive element for addition to a cryogenic dewar to extend its holding time and provide improved shipping ability and to an improved cryostatic sample holder.

BACKGROUND OF THE INVENTION

Cryogenic systems have also long been utilized in the storage and transporting of specimens including human and animal body fluids such as semen. Such systems commonly employ a cryogenic dewar to store and/or transport the specimens. Such a system, as shown in FIG. 1, comprises a cryogenic dewar that typically includes an inner vessel and an outer casing, each having a central opening at their tops, and a neck portion providing a gas-tight interconnection between the openings of the inner vessel and the outer casing at their tops, thereby forming an evacuable space between the inner vessel and outer casing. One or more sample or specimen holders are provided, each with an elongated support with a hook at its distal end to engage the top of the dewar to suspend the holder within the interior of the inner vessel. The sample holders are typically immersed in a bath of a liquid cryogen, commonly nitrogen, maintained in the inner vessel. The bottom of the inner vessel is provided with means, such as a spider-like device, to maintain the spacing of the specimen holders within the inner vessel to prevent their mutual interference upon insertion and removal. The central opening of the dewar is typically closed or fitted with a foam plug.

When a cryogenic dewar fails to maintain cold temperatures during shipping and storage, the samples or specimens being carried therein can very easily be adversely affected, or even destroyed. To extend the sample holding, in the event the cryogenic dewar is inadvertently turned on its side or knocked over during transport, cryogenic shipping dewars have long been provided with a body of cryoretentive material, such as calcium silicate, within the inner vessel, most generally in cylindrical form surrounding the sample holders, as shown in FIG. 1. The cryoretentive element absorbs liquid cryogen and retains the liquid cryogen if the dewar is inadvertently turned on its side, preventing loss of refrigerant and of the insulating thermal gradient of the interconnection between the inner vessel and outer casing.

Many cryogenic dewars, however, have not been provided with cryoretentive material within their inner vessels because there was no such practice at the time of their manufacture or they were not intended for shipping samples.

Accordingly, there is a need in the industry for a convenient conversion of cryogenic dewars that have no protective cryoretentive element for shipping, for improved ability to maintain samples at cold temperatures for longer periods of time and for improved sample holders with protection against the loss of liquid cryogen.

SUMMARY OF THE INVENTION

This invention provides a convenient and inexpensive conversion of cryogenic dewars for shipping, an improved ability to maintain samples in a cold state for longer periods of time and an improved sample holder with protection against a loss of liquid cryogen.

In the invention, an element comprised of a cryoretentive material is adapted for insertion into and support within the inner vessel of a cryogenic dewar adjacent one or more sample holders. Such a cryoretentive element may be adapted for disposition within the canister of existing sample holders and for acceptance of one or more samples, thus permitting the convenient conversion of unprotected dewars for protection against upsets and for improved sample holding times.

One preferred embodiment provided by this invention comprises an open-ended cylindrical canister and an elongated support connected adjacent the open end of the canister. The canister is of the type suited for containing human and animal body fluid samples, particularly semen samples, but carries a cryoretentive element. The elongated support extends generally parallel with a central longitudinal axis of the canister and has at its distal end a projecting hook portion that extends over and engages the dewar adjacent its central opening. One or more such assemblies can be hung within the inner vessel of dewar adjacent samples therein.

In addition, the assembly can be provided, if desired, with a hook portion that extends over and beyond the canister and provides a fulcrum that engages the dewar adjacent the top opening so that when the canister is suspended within the dewar, the canister is urged by gravity in the direction of the projecting portion of the support. The specimen holder can further include a tortuously shaped portion of the elongated support disposed adjacent the canister for preventing the canister from snagging on other canisters within the interior of the dewar as the material holder is being withdrawn from the dewar. The elongated support can even further include a central portion made of thermal insulating material to inhibit the transfer of heat along the support.

This invention thus provides an improved cryostatic sample holder including a cryostatic absorber which provides continued refrigeration closely adjacent a sample to maintain the cold state of a sample in the event the cryogenic dewar is upset or there is a loss of liquid cryogen from within the inner vessel of the dewar. Such cryostatic absorber comprises a cryoretentive element disposed within the specimen holder adjacent the sample.

Other advantages and novel features of the invention will become apparent from the following detailed description of the invention when considered in conjunction with the accompanying drawings.

BRIEF DESCRIPTION OF THE DRAWINGS

FIG. 2 through FIG. 8C show the top portion and sample holders of cryogenic shipping dewar into which the invention can be incorporated;

FIG. 2 is a perspective view of a dewar top housing including a cover and a pair of specimen holders secured thereto;

FIG. 3 is a top plan view of the dewar top housing of FIG. 2 without the cover and specimen holders;

FIG. 6 presents a perspective view of a plug member for closing the central opening of the top housing of FIGS. 2 and 3;

FIGS. 7A–7D present various plan views of a cover adapted to be secured to the dewar top housing;

FIGS. 8A–8C present various views of a specimen holder for use with the dewar of FIGS. 2–7D;

BEST MODE FOR CARRYING OUT THE INVENTION

Figure 1:
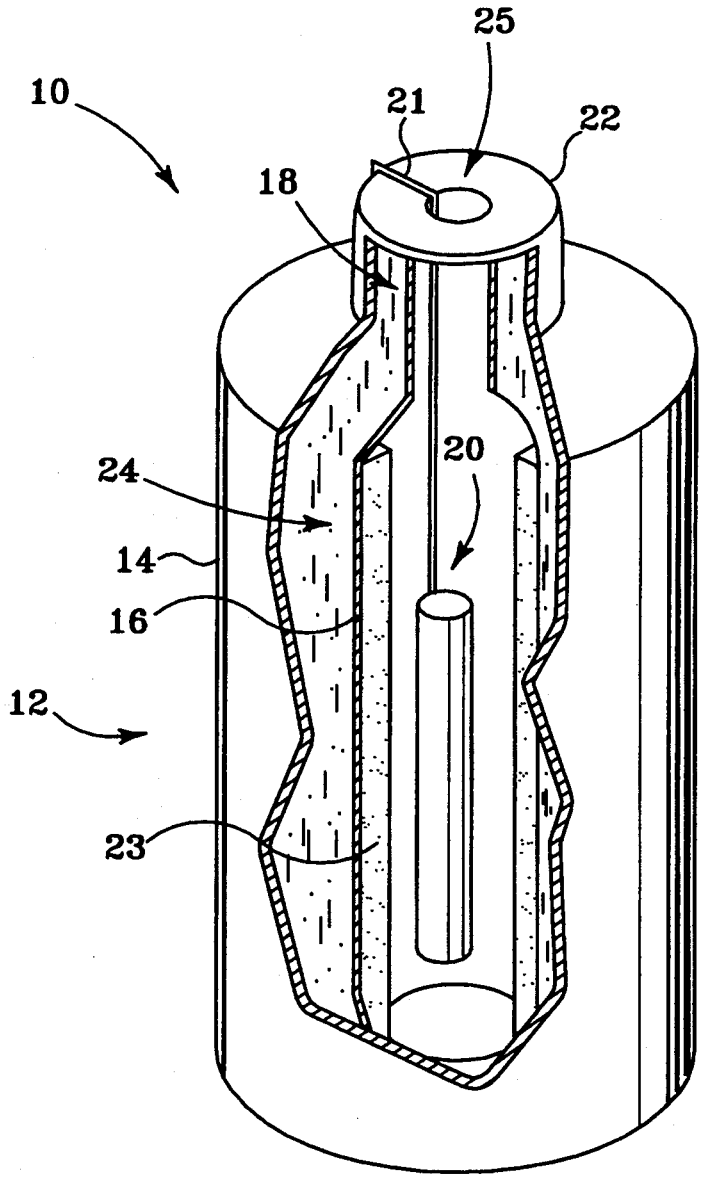
Fig. 1 PRIOR ART
FIG. 1 shows a partially broken away perspective view of a prior art cryogenic shipping vessel.

For purposes of illustration, FIG. 1 presents a partially broken-away and diagrammatic view of prior art cryogenic shipping vessel 10 for storing and transporting specimens, particularly human and animal body fluids such as semen. The prior art cryogenic system 10 of FIG. 1 includes a dewar 12 comprising an outer casing 14 and an inner vessel 16 with each having openings at their tops connected together by a gas-tight neck portion 18, which forms an evacuable space 24 between the outer casing 14 and the inner vessel 16, as well as an opening into the inner vessel 16. As well known in the art the evacuable space 24 is filled with a multiplicity of layers of insulation to reduce heat transfer between the inner vessel and outer casing and to provide support for the inner vessel. Such a conventional system 10 typically includes one or more cylindrical sample or specimen holders 20 provided with an elongated support 21 to engage and be suspended from the top of the dewar so that the sample holder 20 is immersed in a bath of liquid cryogen (not shown) maintained in the inner vessel 16. The one or more specimen holders 20 can be retained separated from each other adjacent the bottom of the inner vessel 16 by a spider (not shown) which can be rotatably carried above the bottom of inner vessel 16 by a spider carrier as in the prior art. The spider can be provided with an inner opening which has a scalloped periphery to provide a plurality of channels to engage the individual specimen holders 20 adjacent their bottoms and maintain their spacing within the inner vessel 16 and reduce their mutual interference during their insertion and removal from the dewar.

Attached to the top of the dewar 12 is a top 22 having a central opening 25 formed therein in communication with the top opening of the dewar 12. The central opening 25 of the top housing 22 is typically closed or fitted with a foam plug.

A body 23 of cryoretentive material, such as a calcium silicate, has, in recent years, been placed within the inner dewar 16 during its manufacture to provide protective cryogenic absorption of liquid cryogen and extended refrigeration capability to the dewar in the event that the dewar is turned on its side on otherwise upset. The cryoretentive material of body 23 absorbs liquid cryogen, such as liquid nitrogen, and retains liquid cryogen within the dewar if it is turned on its side.

Figure 2:
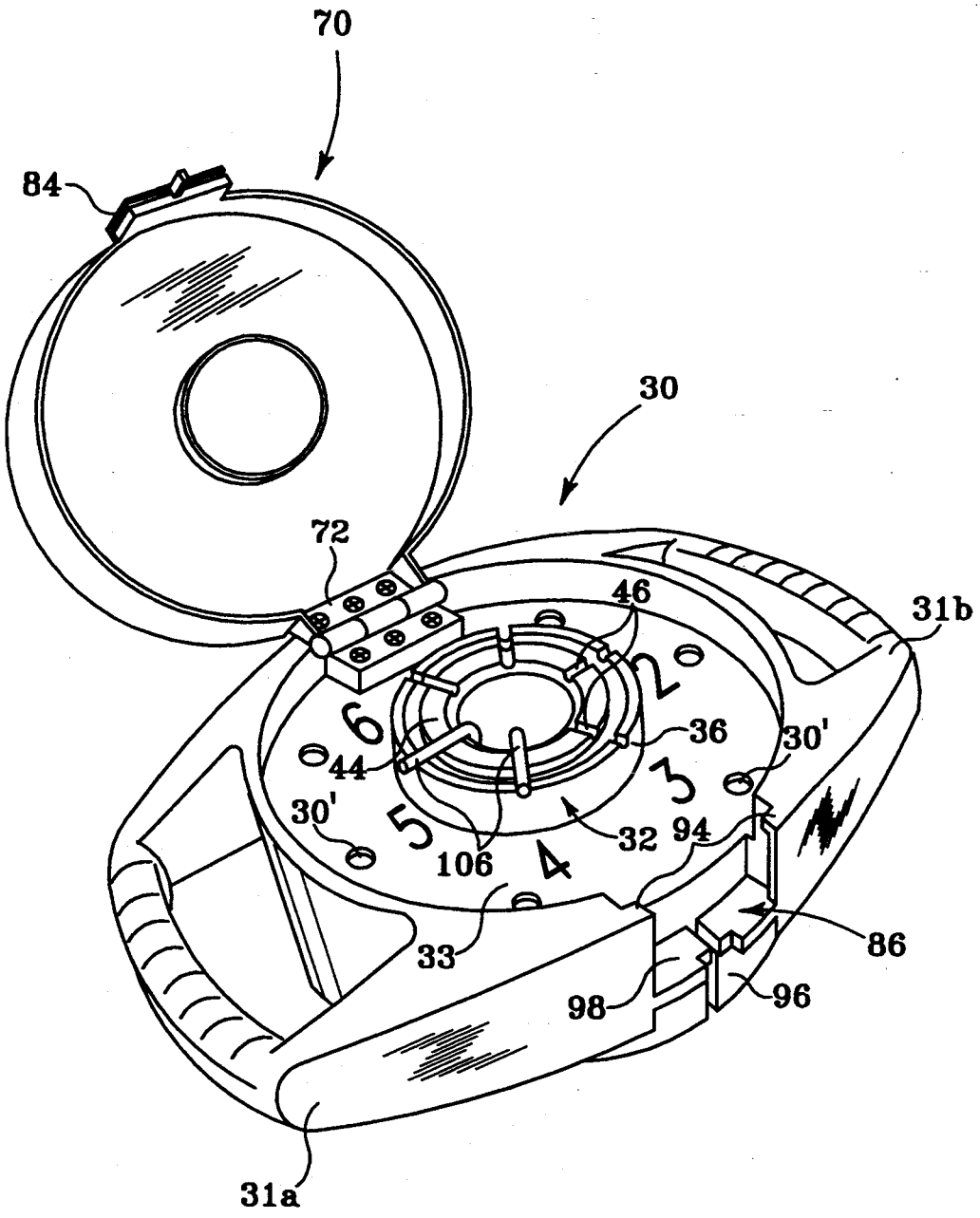
Figure 3:
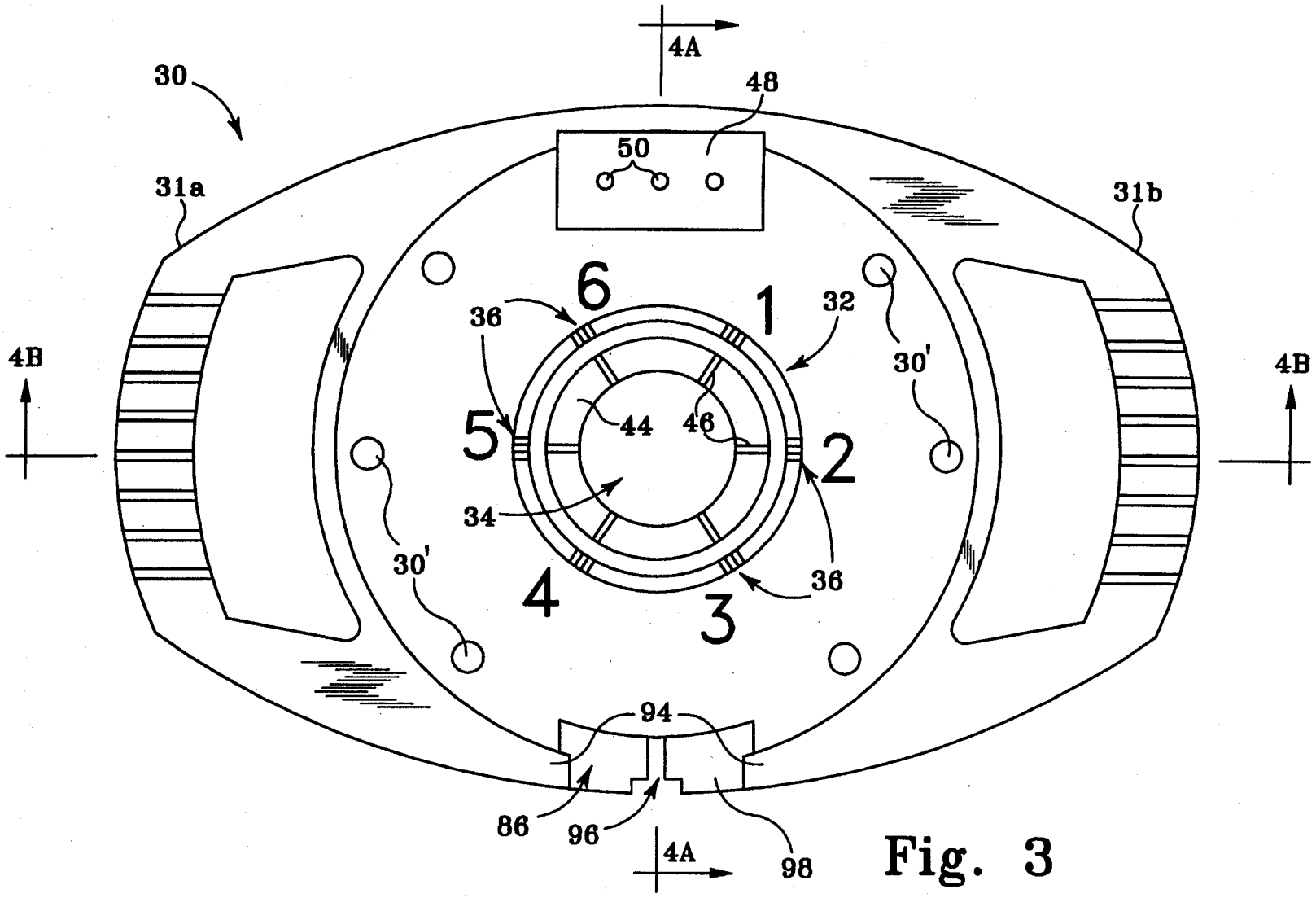
Figure 4A:
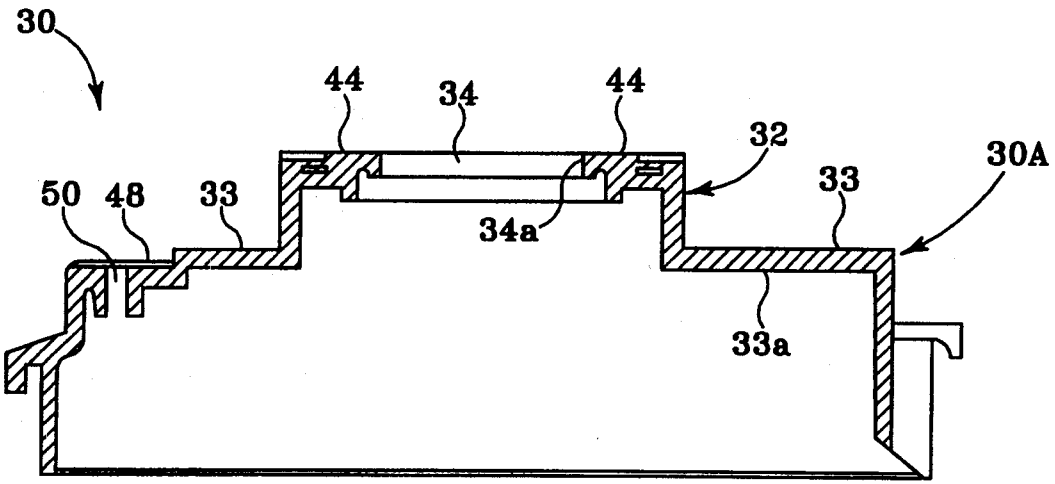
FIGS. 4A and 4B present cross-sectional views taken along line 4A—4A and line 4B—4B, respectively, of the top housing of FIG. 3.
Figure 4B:
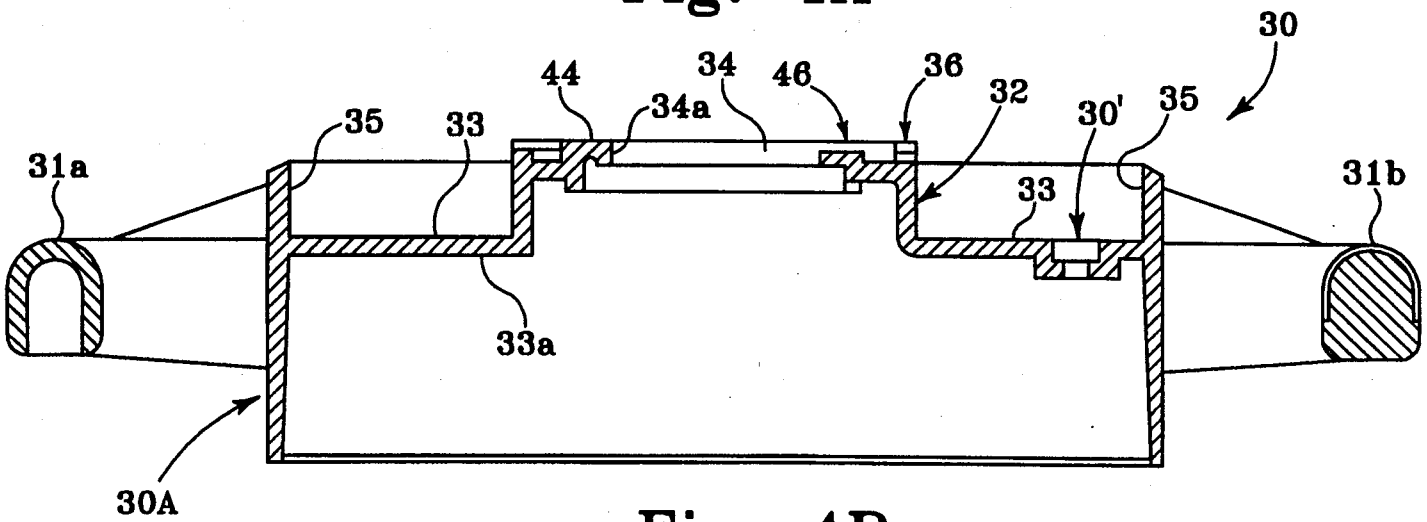
Figure 5A:
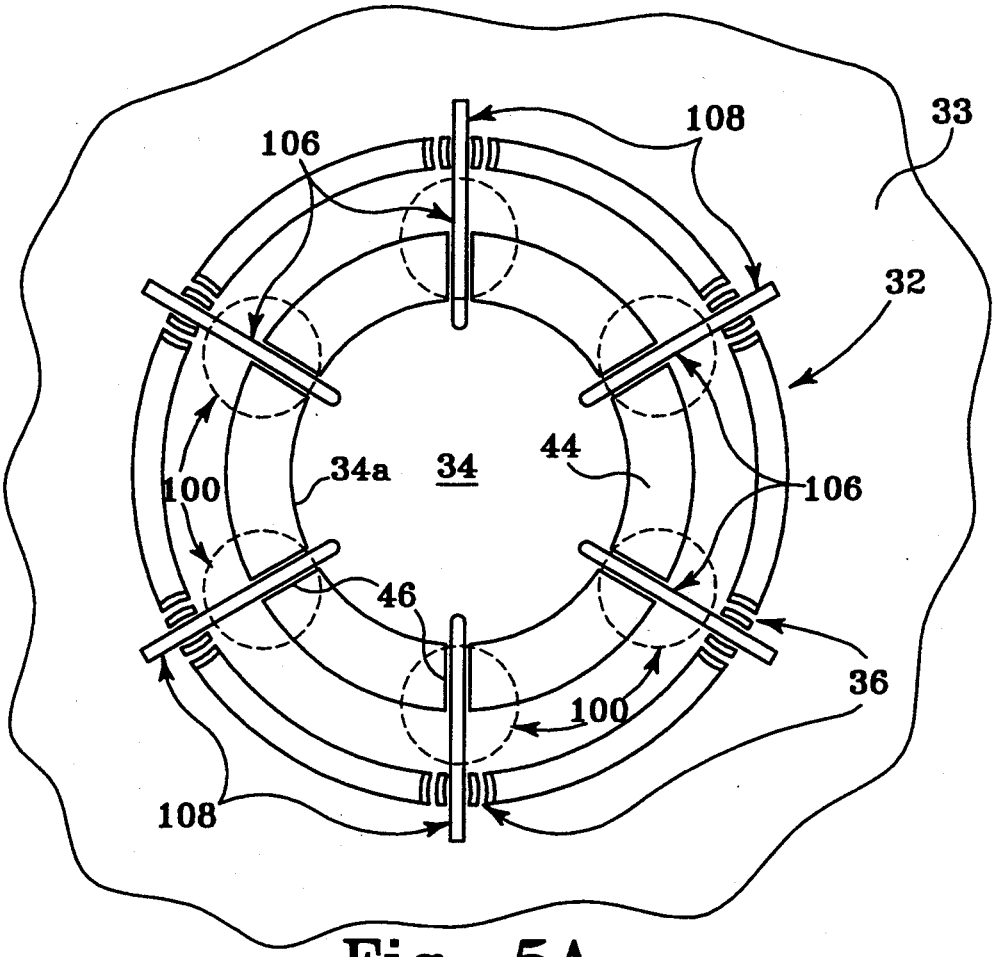
FIG. 5A presents a top plan view in isolation of the annular portion of the top housing of FIG. 2 showing a plurality of specimen holders secured therein.

FIG. 2 presents a perspective view of a preferred top housing assembly of a cryogenic dewar, including a top housing 30 and a cover 70, and FIGS. 3–5 present further various views of the top housing 30. Referring particularly to FIGS. 2 and 3, top housing 30 is intended to be secured over the top opening of the dewar to which it is attached and includes means for maintaining a plurality of specimen holders spaced within the dewar defined by an annular portion 32 having a central opening 34, friction-fitting means defined by a plurality of detent-forming portions 36, and an annular rib 44. Central opening 34 corresponds with the top opening of the dewar (not shown) and allows the insertion and withdrawal of specimen holders into and from the dewar. The plurality of detent-forming portions 36 are circumferentially spaced about the central opening 34 and are adapted to releasably receive a dewar-engaging portion 106 of the elongated support 104 of a specimen holder 100 (see FIGS. 8A–8C). The annular rib 44 is disposed between the central opening 34 and the plurality of detent-forming portions 36 and can include a plurality of spaced radial passageways 46 suited for freely receiving and maintaining, as best shown in FIG. 5A, the spacing of the dewar-engaging portions 106 of the specimen holders 100. Each of the plurality of spaced radial passageways 46 combines with one of the plurality of detent-forming portions 36 to fasten and maintain the spacing of a plurality of specimen holders within the dewar.

FIGS. 4A and 4B present cross sectional views taken along reference planes 4A and 4B, respectively, of the top housing 30 shown in FIG. 3. Top housing 30 can be molded from a suitable plastic material such as GE's LEXAN brand polycarbonate. Top housing 30 forms a shell 30A with annular portion 32 rising above a flat planar surface 33 and an outer wall 35 disposed about the periphery of the top housing 30 extending above planar surface 33. The underside surface 33*a* of planar surface 33 is adapted to abuttingly engage the top of the cryogenic dewar so that the top opening of the dewar is in communication with the central opening 34 of top housing 30 and so that top housing 30 may be secured to the dewar with suitable fasteners through a plurality of openings 30' provided in planar surface 33. Top housing 30 is further provided with a recessed portion 48 adjacent one side of its periphery to provide a seat for receiving a hinge device 72 (FIG. 2) for securing the cover 70 to housing 30 employing fastener-receiving holes 50.

Figure 5B:
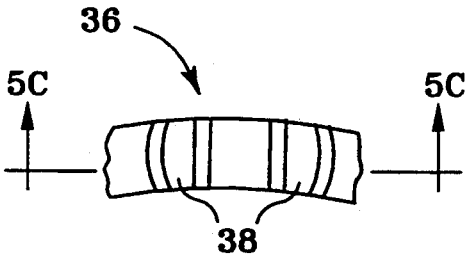
FIGS. 5B and 5C present enlarged isolated views of various aspects of the top housing of FIG. 5A.
Figure 5C:
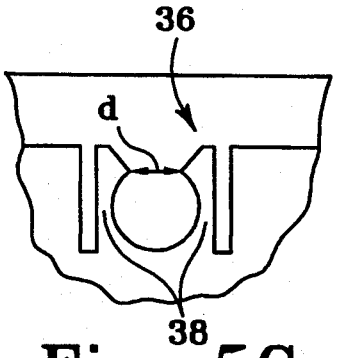

Referring now to FIGS. 5A–5C, FIG. 5A presents a top plan view of the annular portion 32 of top housing 30, FIG. 5B presents an enlarged isolated top view of a single detent-forming portion 36, and FIG. 5C presents an enlarged isolated cross sectional view of the detent-forming portion 36 of FIG. 5B taken along section line 5C.

As can be seen in FIG. 5A, a plurality of specimen holders 100 (shown in phantom lines in FIG. 5A) can be stored within a cryogenic dewar system, spaced circumferentially about the interior of the dewar, and releasably secured in position to prevent their contacting one another or the interior wall of the dewar. The specimen holders 100 are secured about the annular portion 32 of top housing 30 by frictionally fitting (snapping) the dewar-engaging portion 108 of each specimen holder 100 into the detent-forming portions 36. Each of the detent-forming portions 36 are aligned with a radial passageway 46, which is defined by a recessed slot in annular rib 44. The projecting portions 106 of the supports for specimen holders 100 are freely received within the radial passageway 46 so that the detent-forming portions 36, in cooperation with radial passageways 46, secure and maintain the holders 100 in a circumferentially spaced relationship within the interior of the dewar as shown in FIG. 5A.

Detent-forming portion 36, as shown in FIGS. 5B and 5C, includes a pair of upwardly projecting legs 38 that are slightly flexible with their upper portions being spaced apart a selected distance "d" which is slightly lesser than the diameter of the dewar-engaging portion 106 of specimen holder 100. The shorter distance "d" between legs 38 enables the dewar-engaging portions 106 to be "snapped" into place between the legs 38 and be releasably maintained in a fixed circumferential position. Only slight pressure is required to disengage the dewar-engaging portions 106 from the detent-forming legs 38.

Top housing 30 can additionally include indicia for identifying each of the plurality of specimen holders 100 suspended and positioned within the cryogenic dewar. Such indicia can be a plurality of reference numerals disposed on the planar surface 33 of housing 30 as shown in FIGS. 2 and 3, with each reference numeral corresponding to a separate radial passageway 46 and detent-forming portion 36 of annular portion 32. Top housing 30 can even further include a pair of opposed outer portions **31*a* and 31*b*** (FIGS. 2 and 3) forming handles for manually transporting the cryogenic dewar system.

Figure 6:
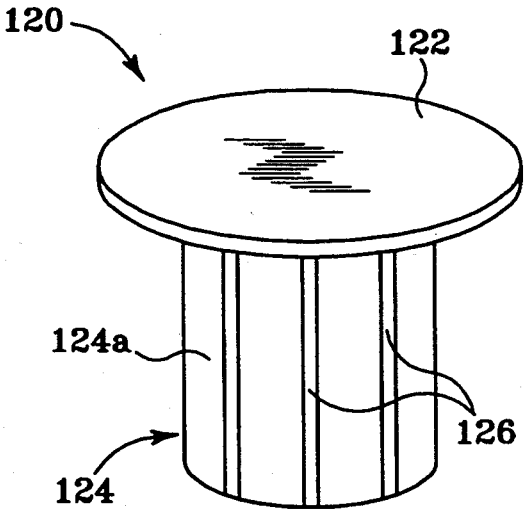

FIG. 6 presents a perspective view of a plug 120 to close the central opening 34 of the top housing 30 of this invention. Plug 120 preferably includes a top portion 122 that extends slightly beyond the diameter of the opening 34 and completely covers the central opening 34 of top housing 30, and a lower stem portion 124 that is adapted to be received within central opening 34. The lower stem portion 124 can additionally include an outer circumferential surface **124*a* that fits closely with the inner circumferential surface 34*a* (FIG. 5A) of the central opening 34 and includes a plurality of vertically grooved channels 126 circumferentially spaced about circumferential surface 124*a* to receive therein the elongated supports 104 of each of the specimen holders 100 to prevent their swaying and to maintain the circumferential spacing of the specimen holders suspended within the dewar. The underside surface of top portion 122 may also include grooved channels that correspond to the vertical grooves 126 provided on lower stem portion 124**.

FIGS. 7A–7D, illustrate a cover 70 adapted to be connected to the top housing 30 by a hinge 72 (see FIG. 2). Cover 70 preferably has a circular shape with a domed top portion 74 and a circular sidewall 76 (shown in partial breakaway cross section in FIG. 7C), and can be molded of a transparent material, such as GE's LEXAN brand polycarbonate, so that the indicia means, i.e., reference numerals 1–6 shown in FIGS. 2 and 3, are visible even when the cover 70 is in the closed position. Cover 70 additionally can include a hinge receiving portion 78 disposed along its periphery comprising a downwardly facing hinge plate-receiving surface 79 and hinge fastener-receiving holes 80. Strengthening ribs 81 can also be provided to impart additional strength to hinge-receiving portion 78.

Cover 70 can further include a releasable latch 84 disposed along its periphery generally opposite hinge-receiving portion 78 to engage a latch-receiving opening 86 provided in the periphery of the top housing 30 (FIGS. 2 and 3) to maintain the cover in a closed position when desired. Latch 84 can include dog-like protrusions 87 extending laterally outwardly from each side of latch 84 adjacent its top and a portion 88 projecting downwardly from the central portion of the latch having an opening 90 formed therein. Latch 84 connects with the circular sidewall 76 of cover 70 by an outwardly extending resilient wall 92 (FIG. 7D), so that when slight hand pressure "P" is applied to the latch 84, the upper portion of latch 84 and protrusions 87 are urged inwardly, as shown by reference arrow 84' in FIG. 7D.

Cover 70 can be used to close and lock the dewar to prevent contamination of and unauthorized access to the specimens stored within the dewar. To close cover 70, the cover is moved downwardly and pressure "P" is applied to the upper portion of latch 84 urging protrusions 87 inwardly so that they move freely past shoulder portions 94 (FIGS. 2 and 3) of the latch-receiving opening 86 and the downwardly projecting portion 88 of latch 84 is received in vertical slot 96 provided in the latch-receiving opening 86 of top housing 30. When the wall 92 of the latch 84 abuttingly engages a horizontal stop surface 98 of latch-receiving opening 86, protrusions 87 snap outwardly immediately below shoulders 94 to retain cover 70 in the closed position. At this stage, downwardly projecting portion 88 of the latch extends through the slot 96 and beyond the stop surface 98 so that opening 90 in portion 88 is unobstructed, thereby permitting a user to place a tamperproof seal or other locking means through the opening 90 to effectively seal or lock the cover 70 in the closed position. To open an unlocked cover, slight hand pressure "P" can be applied to the latch 84 so that the latch is urged inwardly until dog-like protrusions 87 clear the shoulders 94 and permit cover 70 to be moved upwardly.

Figure 8B:
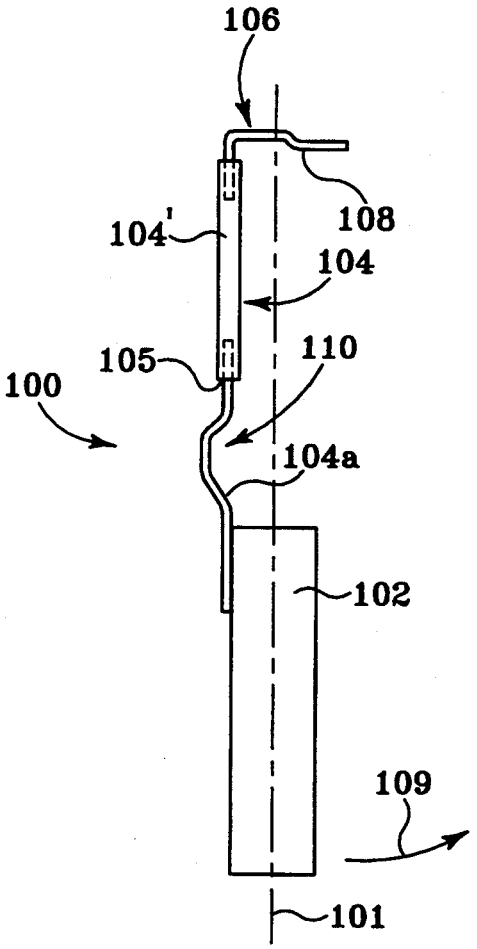
Figure 8C:
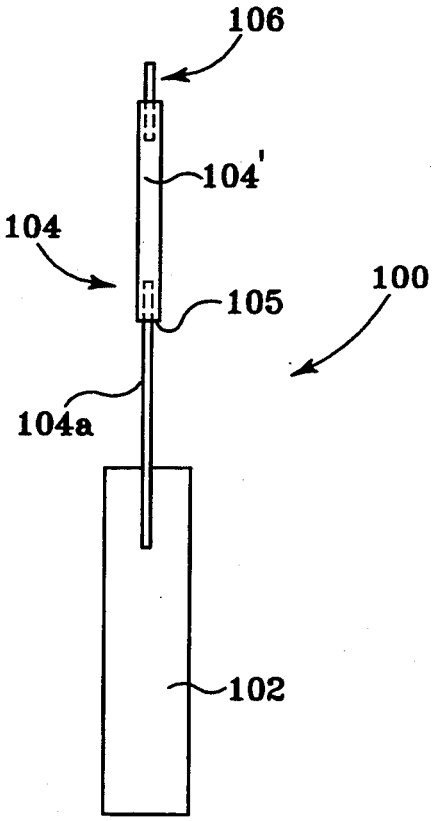
Figure 8A:
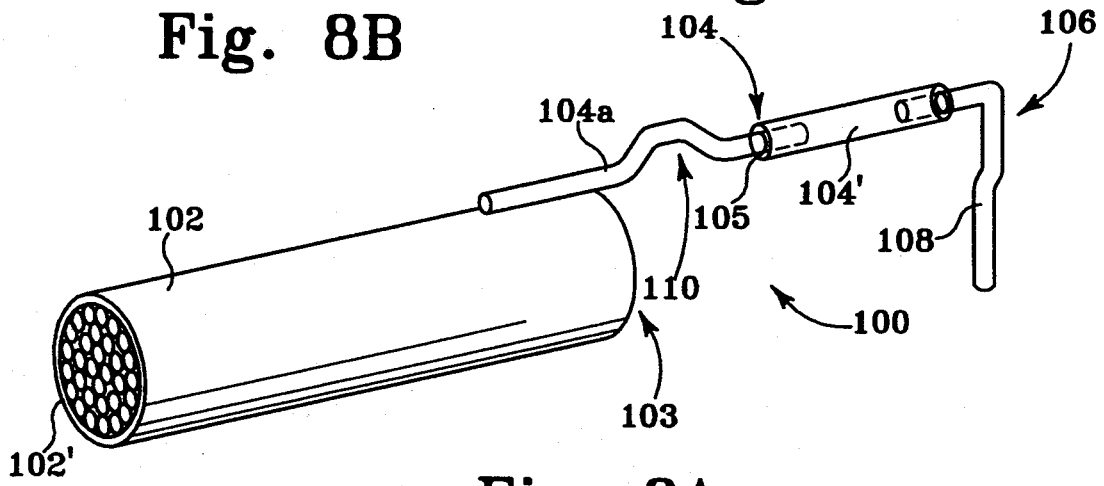

A specimen holder 100 adapted for use with the dewar of FIGS. 2–5C is more completely shown in FIGS. 8A–8C. Specimen holder 100 comprises a cylindrical canister 102 and an elongated support 104 connected to one of the sides of canister 102 at its upper end. Canister 102 has an open end 103 and a perforated member 102' partially closing off the opposing end. Support 104 has at its distal end a projecting portion 106 that projects generally over and beyond the central portion of the canister 102, represented by central axis 101, with a dewar-engaging portion 108 that can be frictionally received within detent-forming legs 38 of annular portion 32. Dewar-engaging portion 108 lies sufficiently beyond the central axis 101 so that, when the material holder 100 is suspended within the dewar through the central opening 34 of the top housing 30, canister 102 is urged radially outwardly in the direction of the projecting portion 106 (as shown by reference arrow 109 in FIG. 8B) to avoid contact with other material holders suspended within the dewar. Such a dewar-engaging portion 108 can also act as a fulcrum for the suspended specimen holder. The positioning of the fulcrum of dewar-engaging portion 108 beyond the center axis 101 of canister 102 takes advantage of gravity in urging the canister radially outwardly toward the dewar walls to avoid contacting other canisters.

The elongated support 104 of canister 102 can also include a portion 104' made of thermal insulating material, such as nylon, polypropylene and glass reinforced epoxy tubing, to inhibit the transfer of heat between the canister 102 and projecting portion 106. Thermal insulating portion 104' can comprise a central plastic tube into which projecting portion 106 is inserted and adhesively attached at its upper end and a rod **104*a* is inserted and adhesively attached at its lower end connecting portion 104' to canister 102**.

Specimen holder 100 can further include means for preventing it from snagging on other specimen holders secured within the interior of the dewar as the specimen holder is being withdrawn therefrom. Specifically, when a specimen holder 100 is removed from within a dewar, it is disadvantageous if the upper end 103 of the canister, which comprises a thin wall, snags or catches on other specimen holders, particularly the lower end 105 of the central tube portion 104' of other specimen holders. Lower end 105 presents an edge that extends outwardly from canister-connecting rod **104*a*. Such snag-prevention means can include a tortuous or bent-shaped portion 110 of elongated support 104 located adjacent to the open upper end 103 of canister 102. Tortuously shaped portion 110 is preferably formed in canister connecting rod 104*a*. As shown best in FIGS. 8A and 8B, portion 110 extends outwardly away from the central axis 101 of canister 102 in the direction opposite of that of projecting portion 106. When the specimen holder 100 is being withdrawn from the interior of the dewar, portion 110 prevents the canister 102 from snagging on edge 105 by urging the canister 102 and its upper end 103 away from the point of engagement so that the open end 103 of the canister avoids the edge 105 of the elongated supports of other specimen holders within the dewar. Such means permits the unobstructed removal of the specimen holder 100** from the dewar interior.

In this invention a cryoretentive element can be added within the inner vessel of cryogenic dewars of all ages to prolong refrigeration of any contents in the event of accidental upset of the dewar. The cryoretentive element comprises a body of cryoretentive material that is adapted for insertion within the inner vessel adjacent one or more specimen holders. A cryoretentive material is a material that combines the ability to absorb and retain liquid cryogen and an effective thermal capacity (which in the cryoretentive element of the invention reflects its absorption of a relative high quantity of heat per degree of temperature increase per unit of mass). Calcium silicates are a preferred cryoretentive material for use in the invention. The use of a cryoretentive element in a cryogenic sample holder will permit cryostatic adsorption to be conveniently and economically added to a cryogenic dewar to retain cryogenic cooling adjacent a sample for an extended period of time following a dewar upset or loss of liquid cryogen.

Figure 9:
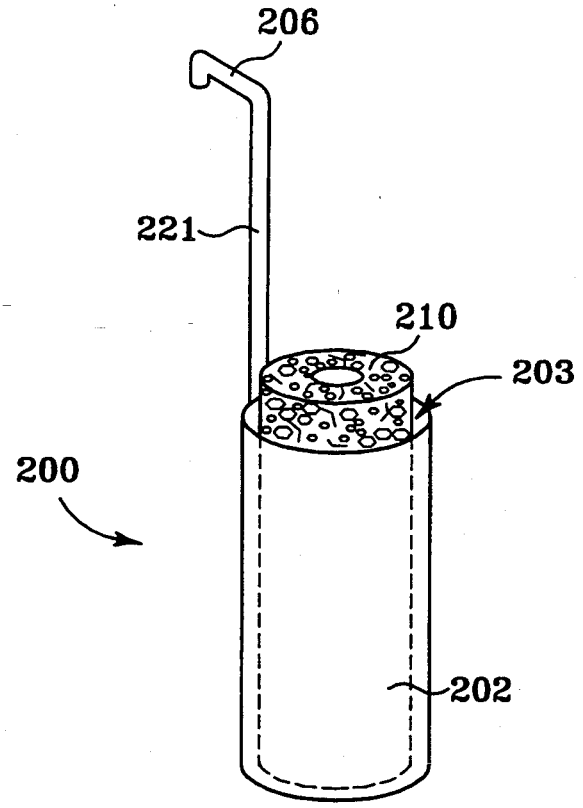
FIG. 9 is a perspective view of a cryoretentive sample holder provided by this invention.

As shown in FIG. 9, such a cryogenic sample holder 200 can include a cryoretentive element 210 adapted to be disposed within the sample holder 200. Such a cryoretentive element 210 can be used in any conventional sample holder, (e.g., such as that shown in FIG. 1 having a substantially straight elongated support 221 to engage the top of the dewar and suspend the holder 200 from above). Such a cryoretentive element 210 can be used with the novel sample holder 100 shown and described in relation to FIGS. 8A–8C. The cryoretentive element 210 can fill the canister 202, as shown in FIG. 9, or a cryoretentive element may be added to the canister of a sample of specimen holder adjacent one or more samples or specimens.

Cryoretentive element 210 is a body of cryoretentive material, such as a calcium silicate, for example, which can be any of the silicates of calcium, including tricalcium silicate, $Ca_3SiO_5$; dicalcium silicate, $Ca_2SiO_4$; and calcium metasilicate, $CaSiO_3$. Cryoretentive element 210 and its absorbed liquid cryogen maintain refrigeration of a sample by absorbing heat from the surrounding environment and maintaining the cold temperature of the sample holder and the sample. As shown in FIG. 9, cryoretentive element 210 can have a cylindrical shape specifically dimensioned so as to be received within the canister 202 of a sample holder 200.

In use, small containers of refrigeratable human or animal body fluid samples are placed through open end 203 of canister 202 of FIG. 9 and the cryoretentive element, or cryostatic absorber, 210 is then inserted down into the canister 202 of holder 200, which in turn is then inserted through the central opening 34 of the top housing 30 so that the canister becomes immersed in a liquid cryogen, such as liquid nitrogen, contained in the interior vessel 416 of the dewar 412. The projecting portion 206 of specimen holder 200 is then placed in one of the radial passageways 46 of annular rib 44 (FIGS. 2–5) and is snap-fitted into the corresponding detent-forming portion 36 (see particularly FIG. 5A) to detachably secure the specimen holder in a spaced relationship within the interior of the dewar. Cryoretentive element 210 absorbs liquid cryogen and can thereafter maintain a cold state closely adjacent a sample in canister 202 even if the cryogenic dewar is turned on its side or otherwise upset.

Figure 10A:
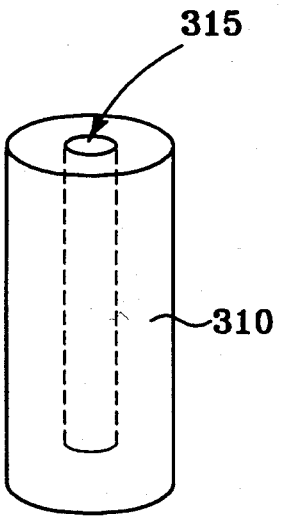
FIG. 10A is a perspective view of an alternative cryoretentive element provided by this invention and adapted to carry a sample there within.
Figure 10B:
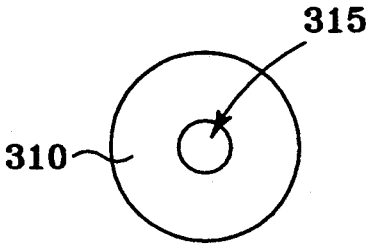
FIG. 10B is a top plan view of the cryoretentive element of FIG. 10A.

Alternatively, the cryoretentive element of this invention can have one or more bores of appropriate size formed therein for receipt of one or more samples or specimens. For example, as shown in FIGS. 10A and 10B, cryoretentive element 310 can have a central axial bore 315 extending completely or partially therethrough. In use, element 310 is designed to be received within the canister of a sample holder with the sample placed down into the axial bore 315 of element 310 to maintain the sample in a cold state, especially in the event the cryogenic dewar is turned on its side and the cryogenic liquid is lost from the inner vessel of the dewar or the dewar otherwise loses its liquid cryogen. To provide further enclosure of a sample carried within cryoretentive element 310, the element 310, before being inserted into the canister of a sample holder, can be inverted so that the axial bore 315 fits down over and receives the sample therein, thereby avoiding exposure of the top portion of the sample through axial bore 315, as would be the case when element 310 is used in the upright position as shown in FIG. 10A.

Figure 11:
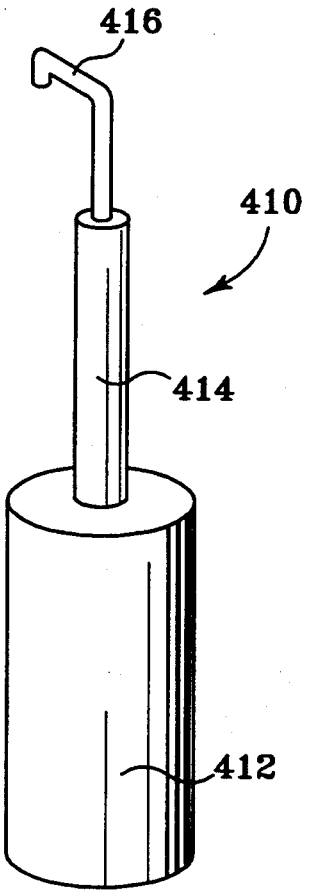
FIG. 11 shows another embodiment of a cryoretentive element of this invention.

FIG. 11 shows further embodiment of a cryoretentive element of the invention. As shown in FIG. 11, a cryoretentive element 410 can comprise a cylindrical body 412 of cryoretentive material approximating the size of a conventional sample holder with a extending rod-like portion 414 of cryoretentive material that is provided with an insulative hook portion 416. One or more such cryoretentive elements may be inserted into a cryogenic dewar in place of one or more sample holders to add cryostatic absorption and retention to a dewar.

Figure 12:
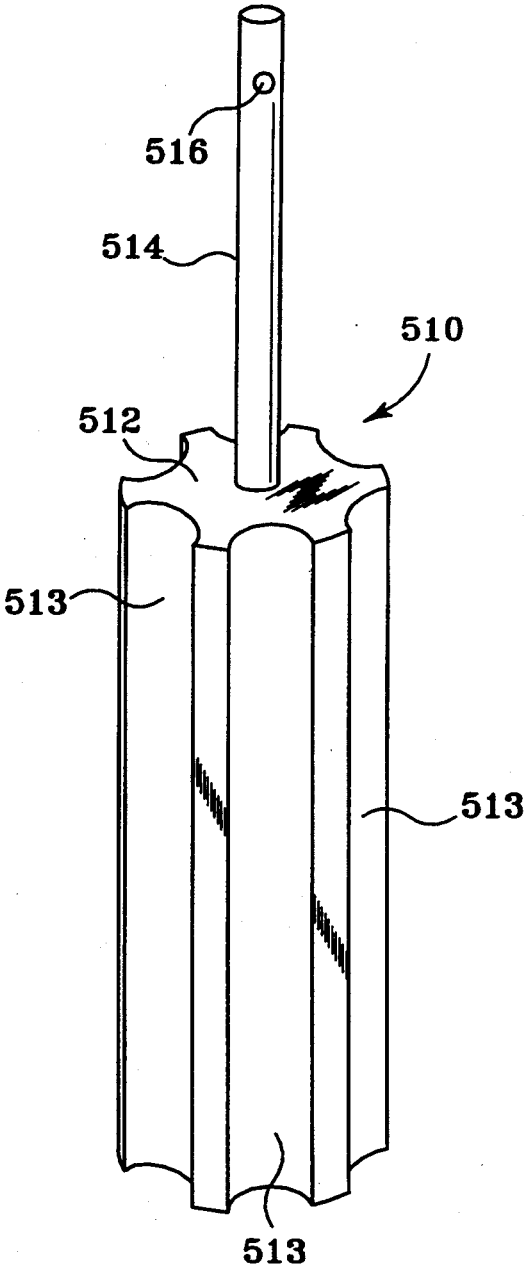
FIG. 12 shows yet another embodiment of a cryoretentive element of this invention.

FIG. 12 show a still further embodiment of a cryoretentive element of the invention. As shown in FIG. 12, a cryoretentive element 510 can comprise a fluted cylindrical body 512 of cryoretentive material which is adopted for insertion into a cryogenic dewar within a plurality of sample holders. The body 512 can be provided with a plurality of flutes 513 that are adopted to provide engagement with and spacing for a plurality of sample holders within the inner vessel of a dewar. Such a cryoretentive element can be provided with a rod like portion 514 of either cryoretentive material or thermally insulative material, and the rod like portion 514 can be provided with a hole 516. Cryoretentive element 510 can, thus, be supported by the floor of the inner vessel, with hole 516 available for use in its removal, or can be hung from the top of the dewar by an insulative hook that engages hole 516 like other sample holders.

The form and manner of support of the additional cryoretentive elements of the invention can be varied to accommodate the design of the cryogenic dewars to which they may be added, and the cryoretentive elements of the invention are useful to provide conveniently, effectively and economically cryoretentive material to dewars with no such protective cryogenic absorption, or to add cryoretentive material and the protection of cryogenic absorption in more effective locations adjacent the samples or specimens within a cryogenic dewar in a convenient and economical way.

Thus, this invention provides an improved cryogenic storage and transporting system as disclosed above. It must be understood, however, that the invention is not limited to the preferred embodiments and best mode of operation currently understood and described herein, but is only limited by the scope of the following claims.

What is claimed is:

1. In cryogenic dewar including an outer casing and an inner vessel, with said outer casing and inner vessel having openings at their tops interconnected by a gas-tight neck portion to form an evacuable space between the outer casing and the inner vessel and a dewar reduced-diameter opening into the inner vessel, said evacuable space containing thermal insulating material to inhibit the transfer of heat therethrough; and one or more specimen holders, each comprising an open-end cylindrical canister and an elongated support connected at one end adjacent the open end of the canister and having at the other end a projecting portion for engaging the top of the dewar opening to suspend said specimen holder within the interior of said inner vessel; the improvement comprising a removable element comprising a cryoretentive material and adapted for insertion and support adjacent said one or more specimen holders, within the inner vessel of said cryogenic dewar.

2. In a cryogenic dewar including an outer casing and an inner vessel, with said outer casing and inner vessel having openings at their tops interconnected by a gas-tight neck portion to form an evacuable space between the outer casing and the inner vessel and a dewar opening into the inner vessel, said evacuable space containing thermal insulating material to inhibit the transfer of heat therethrough; and one or more specimen holders each comprising an open-end canister and an elongated support connected at one end to the canister and having at the other end a portion for engaging the dewar at its top to suspend said specimen holder within the interior of said inner vessel; the improvement wherein an element of cryoretentive material is disposed in one or more canisters of one or more of said specimen holders adapted for insertion and support within the inner vessel of said cryogenic dewar.

3. The improvement of claim 2 wherein said cryoretentive material is a calcium silicate.

4. The improvement of claim 2 wherein said cryoretentive material includes at least one axial bore for receiving said specimen.

5. In a cryogenic dewar including an outer casing and an inner vessel, within said outer casing and inner vessel having openings at their tops interconnected by gas-tight neck portion to form an evacuable space between the outer casing and the inner vessel and a dewar opening into the inner vessel, said evacuable space containing thermal insulating material to inhibit the transfer of heat therethrough; and one or more specimen holders each comprising an open-end canister and an elongated support connected at one end to the canister and having at the other end a portion for engaging the top of the dewar opening to suspend said specimen holder within the interior of said inner vessel; the improvement wherein an element of cryoretentive material is adapted for insertion and support adjacent said one or more specimen holders, within the inner vessel of said cryogenic dewar, and includes an insulative projecting portion for engaging the top of the dewar opening for suspension adjacent the one or more specimen holders within the inner vessel.

6. The improvement of claim 1 wherein said element of cryoretentive material has an outer surface for engaging one or more specimen holders when inserted within the inner vessel.

7. The improvement of claim 1 wherein said element of cryoretentive material is adapted for insertion within the inner vessel through said dewar opening and for support and retention therein adjacent one or more specimen holders by the bottom of the inner vessel.

8. The system of claim 7 wherein said cryoretentive material is a calcium silicate.

9. In a sample holder for use in a cryogenic dewar having a central opening therein, said sample holder including a canister for carrying one or more samples and an elongated support attached to the canister for suspending said canister within the dewar from above the canister, said elongated support having a projecting portion at its distal end for engaging the dewar, the improvement wherein said sample holder includes a body of cryoretentive material adapted to be carried within the canister adjacent a specimen therein.

10. The sample holder of claim 9 wherein said cryoretentive element comprises a calcium silicate.

11. The sample holder of claim 9 wherein said body of cryoretentive material includes one or more axial bores for receiving therein one or more specimens to be refrigerated.

12. The sample holder of claim 11 wherein said body of cryoretentive material has a cylindrical shape, and wherein said one or more axial bores extends and longitudinally adjacent its outer surface.

13. In a cryogenic dewar including an outer casing an an inner vessel for holding a liquid cryogen, said outer casing and inner vessel having an opening interconnected by a neck portion providing a gas-tight connection between the openings and forming, between the outer casing and inner vessel, an evacuated and thermally insulated intervening space, the improvement comprising one or more bodies of cryoretentive material adapted for insertion through said opening and neck portion into said liquid cryogen within the inner vessel and adapted to be removably carried adjacent the top of the dewar.

14. In a cryogenic dewar including an outer casing and an inner vessel for holding a liquid cryogen, said outer casing and inner vessel having an opening interconnected by a neck portion providing a gas-tight connection between the openings and forming, between the outer casing and inner vessel, an evacuated and thermally insulated intervening space, the improvement comprising one or more cryostatic absorbers of cryoretentive material adapted for insertion through said opening and neck portion into said liquid cryogen within the inner vessel and adapted for location adjacent one or more sample holders and for engagement with supporting means comprising an insulative hook portion for engaging the top of the dewar.

15. In a cryogenic dewar including an outer casing and an inner vessel for holding a liquid cryogen, said outer casing and inner vessel having openings interconnected by a neck portion providing a gas-tight connection between the openings and forming, between the outer casing and inner vessel, an evacuated and thermally insulated intervening space, the improvement comprising one or more cryostatic absorbers of cryoretentive material adapted for insertion through said opening and neck portion into said liquid cryogen within the inner vessel and including a cylindrical body of cryoretentive material and an insulative hook for engaging the dewar.

16. The improvement of claim 13 wherein said cryostatic absorber includes a fluted cylindrical body.

17. The cryogenic dewar of claim 13 wherein the cryoretentive material comprises a calcium silicate material.

18. A cryostatic absorber for a sample being refrigerated in a cryogenic dewar, comprising an element that is constructed of cryoretentive material and is dimensioned for use within a canister carried within the inner vessel of the dewar.

19. The cryostatic absorber of claim 18 wherein said element has at least one axial bore for enclosing therewith said sample when the element is disposed within the canister.

20. A method of converting, to a vapor shipping dewar, a dewar comprising an outer casing and inner vessel for holding liquid cryogen, said outer casing and inner vessel having openings at their tops interconnected by a dewar necked portion providing a gas-tight connection between the openings in forming, between the outer casing and inner vessel, an evacuated and thermally insulated space, the method comprising the steps of:

providing at least one body of cryoretentive material adapted for insertion through the necked portion of the dewar and for supportive engagement with the dewar;

engaging the at least one body of cryoretentive material with said dewar so said at least one body of cryoretentive material is removably carried within said inner vessel.

21. The method of claim 20 wherein the at least one body of cryoretentive material is carried by a canister, said canister including a portion adapted for engagement with said dewar adjacent its top.

22. The method of claim 20 wherein the at least one body of cryoretentive material is disposed for location adjacent one or more specimen holders.

* * * * *